US008267004B2

(12) United States Patent
Heitz, Jr.

(10) Patent No.: US 8,267,004 B2
(45) Date of Patent: Sep. 18, 2012

(54) ADAPTABLE HYDRAULIC CONTROL SYSTEM

(75) Inventor: Arthur Heitz, Jr., Sioux Falls, SD (US)

(73) Assignee: Lifetime Enterprises, LLC, Sioux Falls, SD (US)

( * ) Notice: Subject to any disclaimer, the term of this patent is extended or adjusted under 35 U.S.C. 154(b) by 0 days.

(21) Appl. No.: 12/784,383

(22) Filed: May 20, 2010

(65) Prior Publication Data

US 2010/0294384 A1 Nov. 25, 2010

Related U.S. Application Data

(60) Provisional application No. 61/180,066, filed on May 20, 2009.

(51) Int. Cl.
*F15B 13/044* (2006.01)

(52) U.S. Cl. ..... 91/459; 137/596.17

(58) Field of Classification Search ..... 91/459; 137/596.17

See application file for complete search history.

(56) References Cited

U.S. PATENT DOCUMENTS 3,762,076 A * 10/1973 Eftefield ..... 91/459
3,952,509 A 4/1976 Coleman
4,043,099 A 8/1977 Cheatum
4,047,587 A 9/1977 Anstey
4,186,771 A * 2/1980 Matsumoto ..... 137/596.17
4,548,229 A 10/1985 Johnson
4,766,803 A 8/1988 Cartee et al.
5,245,827 A 9/1993 Durant et al.
5,419,129 A 5/1995 Becker et al.
5,778,755 A 7/1998 Boese
5,921,279 A 7/1999 Barber
5,975,215 A 11/1999 Jensen et al.
6,029,445 A 2/2000 Lech
6,068,197 A 5/2000 Tolson
6,435,053 B1 8/2002 Guiet et al.
6,490,962 B1 12/2002 Schultz
6,561,076 B2 5/2003 Hou et al.
7,025,556 B1 4/2006 Koffman et al.
7,047,735 B2 5/2006 Sprinkle et al.
7,066,417 B2 6/2006 Lepage et al.
7,127,998 B2 10/2006 MacDonald et al.
7,143,579 B2 12/2006 Foster et al.
7,243,690 B1 7/2007 Price et al.
7,246,479 B2 7/2007 Spaniol et al.
7,249,565 B2 7/2007 Schuster
7,251,934 B2 8/2007 Lech et al.
7,316,111 B2 1/2008 Krieger
7,337,610 B2 3/2008 Bitter
2008/0095597 A1 4/2008 Heitz

* cited by examiner

*Primary Examiner* — F. Daniel Lopez
(74) *Attorney, Agent, or Firm* — Santangelo Law Offices, P.C.

(57) ABSTRACT

An adaptable hydraulic control system configured to be used with either open-center or closed-center hydraulic power systems which may include one or more switches, one or more hydraulic circuits to operate a sequence of motions and may include a shunt relief valve to permit operation with an open-center hydraulic innervator control valve(s) powered by wither an open-center system or a closed-center system. Series switches may control a sequence of operation by transitioning between different normal, or default states to act upon and control repositioning of a hydraulic innervator control valve(s) that may itself have normal or default states perhaps such as for forward operational flow, backward operational flow, or neutral pass through flow.

22 Claims, 5 Drawing Sheets

ADAPTABLE HYDRAULIC CONTROL SYSTEM

This is a United States Non-Provisional Patent Application claiming the benefit of and priority to U.S. Provisional Application No. 61/180,066 filed May 20, 2009, hereby incorporated by reference in its entirety.

TECHNICAL FIELD

This invention relates to an adaptable hydraulic control system that may generally encompass a multiple system adaptable hydraulic interconnected system that for example, may be adapted for use with either an open-center, or closed-center hydraulic system. Some embodiments of the current inventive technology relate to a system for control of a hydraulic system that may utilize an electrically switched hydraulic control system to achieve such an open-center, or closed-center compatible hydraulic system adaptable system. Methods and apparatus for the control of disparate hydraulic systems are contemplated that may adaptively accommodate hydraulic systems that may exhibit variable functional characteristics such as high and low pressure, variable volume flow rates, constant volume flow rates, and other flow rates and the like. The inventive technology in some embodiments may be particularly suited for controlling various disparate hydraulic systems that may operate at variable pressure and/or volume flow rates and the like. An exemplary embodiment of such may include for illustration purposes an agricultural apparatus, such as a hay baler accumulator or other similar device(s) that use hydraulic systems.

BACKGROUND

The use of hydraulic systems is pervasive in modern machinery. Hydraulic systems are an efficient means to transmit power through pressurized fluids to accomplish mechanical work. Though varied in design, many systems may utilize several common elements. In many applications, a main system supplies power to one or more subsystems, which are sometimes referred to as circuits. The basic components of a generalized hydraulic fluid power system may include a hydraulic fluid reservoir, a pump or compressor, transmitter lines, directional control valve(s), and an actuator. In addition, hydraulic systems may further be classified into open-center and closed-center systems.

A typical open-center hydraulic system may contain a hydraulic innervator control valve or a flow control valve that is "open" while in its center or neutral position allowing for hydraulic fluid or pump flow to pass through the valve and return to a reservoir. Open-center systems are customarily operated at relatively low pressures and may generally be used to operate a single actuator function or even movement. Such open-centered systems may exhibit reduced effectiveness when trying to operate several actuator functions/movements at once.

In a typical closed-center system, a flow control valve, when positioned in the center or neutral position, may be closed, stopping the flow of hydraulic fluid from an adjustable pump to an actuator. As a result, in a closed-center system, when a flow control valve is in a closed position, the adjustable pump may rest, reducing or stopping the flow of hydraulic fluid (or fluid) to, or from an adjustable pump. Closed-center systems customarily operate at relatively high pressures (as compared to open-center hydraulic systems) and generally may be configured to simultaneously and efficiently operate several actuator functions/movements.

A simple example demonstrates the difficulties of integrating both open-center and closed center hydraulic systems, and the long felt need within the industry of being able to simultaneously operate both systems using one adaptable hydraulic control system. For example, modern U.S. agricultural tractors are often configured with constant pressure hydraulic systems configured in the closed-center position, where a hydraulic innervator control valve allows the flow of fluid to an actuator when it is in the neutral position. On the other-hand, modern European tractors are often configured in an open-centered position, where a hydraulic innervator control valve allows for the pass-through of hydraulic fluid, or pump flow back to a reservoir in the neutral position. As a result of these two hydraulic operating systems, it may be impractical and prohibitively expensive to combine U.S. and European agricultural equipment due to this incompatibility.

Several approaches have been attempted to address this incompatibility between open-centered and closed-centered hydraulic systems. One approach has been to use multiple pumps to provide hydraulic fluid (or fluid) to a plurality of hydraulically controlled actuators, where for example one adjustable pump would, as one example, supply fluid to an low pressure, low flow volume open-center system, while another would provide fluid to a high pressure, high flow volume closed-center system. Such configurations often can be inefficient and prohibitively expensive. Others examples may include the use of complex switching of components, load sensing devices, manual switching of parts, variable pump controls, flow dividers, and/or any number of combinations of these elements.

Hydraulic systems have yet to practically address a self-contained hydraulic control system that may be compatible with, and adaptively integrate both high and low pressure, and variable volume flows, that are indicative of open-center and closed-center hydraulic systems, that do not require user modification, interaction or intervention.

Certain embodiments of the current inventive technology may involve a hydraulic control system that may operate with, or as an open-center or closed-center hydraulic system. Embodiments of the current adaptable hydraulic control system may be applied and expanded into numerous practical embodiments. For example, the current adaptable hydraulic control system may include numerous embodiments for various agricultural, mechanical, and/or industrial applications and the like, as can be readily appreciated by those skilled in the art. In the current application one exemplary embodiment, namely a hydraulic hay baler accumulator having a plurality of components that are hydraulically controlled is described for illustration purposes only and not should be seen as limiting the current inventive technology as such.

SUMMARY OF THE INVENTION

The present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Embodiments of the invention may practically solve the problem of providing an adaptable hydraulic control system for a hydraulic structure, that can accommodate an open-center or a closed-center system with no need for operator decision or action in desired instances, and may in some embodiments be considered as self-contained. As will be described in more detail below, certain embodiments may use a series of switches to control an open-center valve, with a open-neutral position that may allow for pump flow to pass through a hydraulic innervator control valve, or a flow control valve to a reservoir that may be operated at either the high or low pressure, and/or flow volume found in closed-center and open-center systems respectively. In some embodiments the invention may be entirely self-contained, such that there may be no additional pumps, valves, stoppers, pump flow dividers, switches or parallels systems that need to be installed or modified, thus allowing for the current adjustable hydraulic control system to operate at both high and low pressures as well as variable volumes flow rates automatically without any modifications, operator switching, or changes to the system.

The inventive technology in certain embodiments relates to methods and apparatus for the control of a hydraulic systems that may operate at both high and low pressure, and variable volume flow rates and may include one or more of the following features: methods and apparatus for multiple direction actuator function/movement in a plurality of directions and planes; methods and apparatus for integrating and/or accommodating both an open-center and closed-center hydraulic system; methods and apparatus for self-contained accommodating both an open-center and closed-center hydraulic system without user modification or interaction; methods and apparatus for operating embodiments of a hydraulic control system at a variety of ranges of pressure and volume flow rates; methods and apparatus for operating embodiments of a hydraulic control system with a series of switches and hydraulic innervator control valve(s) (5) innervating a single, or plurality of actuators; methods and apparatus for operating embodiments of a hydraulic control system utilizing a shunted hydraulic system; methods and apparatus for embodiments of a hydraulic control system operating a closed-center hydraulic system with an open-neutral flow control valve/apparatus normally found in an open-centered system.

Accordingly, the objects of the methods and apparatus for the control of a hydraulic system that can operate at both high and low pressure and variable volume flow rates described in the embodiments herein address each of the foregoing in a practical manner. Further objects of the invention will become apparent from the description and drawings below.

DESCRIPTION OF THE PREFERRED EMBODIMENT(S)

Figure 1:
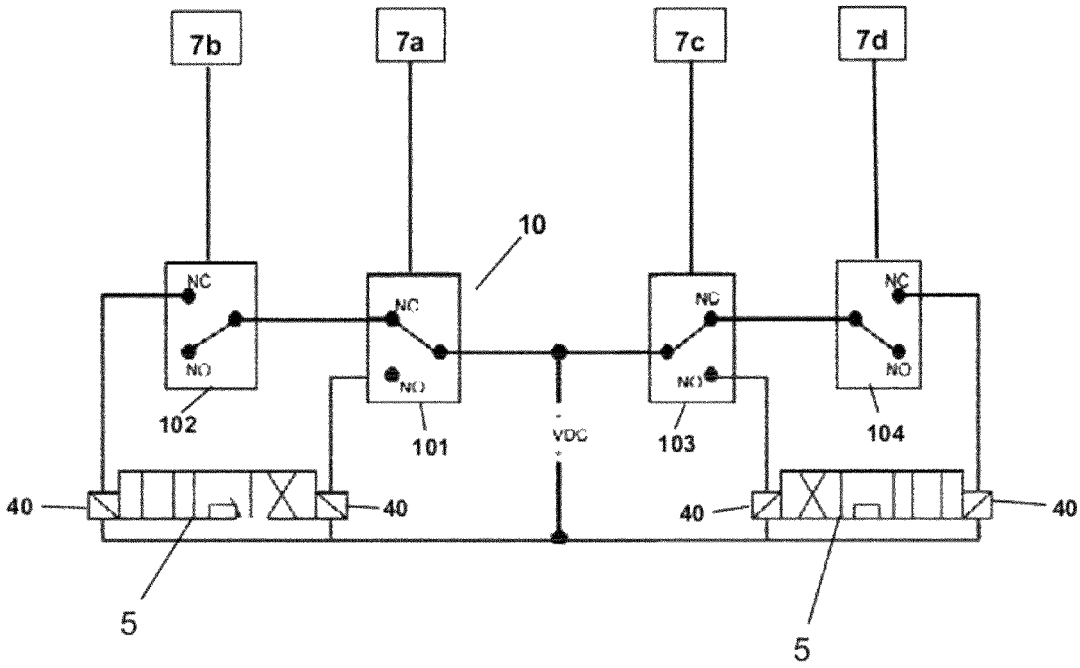
FIG. 1—Generally depicts a self contained disparate hydraulic source condition adapter composite in one exemplary embodiment.

As mentioned earlier, the present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Generally referring to FIGS. 1-5, the inventive technology may include a multiple system (perhaps open-centered and closed-centered) adaptable hydraulic interconnect system which may include but not be limited to perhaps the following: a reservoir configured to contain a hydraulic fluid (1*a*); a pump fluidically capable of displacing at least some of said hydraulic fluid (1*b*); a transmission line fluidically responsive to said pump (2); a connector element (4); a hydraulic innervator control valve (5); at least one multiple direction actuator responsive to said hydraulic innervator control valve (6); at least one movement trigger element (7); and a self contained disparate hydraulic source condition adapter composite (8). Additional embodiments may additionally include at least one paired series interconnect switch assembly to which said hydraulic innervator control valve is responsive (45), forming in some embodiments an electrically switched hydraulic control system.

In certain embodiments of the current inventive technology, such a self contained disparate hydraulic source condition adapter composite (8) may include, but not be limited to the following: at least one open center and/or closed center capable adapter; at least one high pressure capable adapter and/or at least one low pressure capable adapter; at least one constant pressure and/or at least one demand pressure capable adapter; at least one constant flow capable adapter and/or at least one variable flow capable adapter; at least one single component capable adapter; at least one multiple component capable adapter; at least one high flow capable adapter and/or capable adapter at least one low flow capable adapter; and at least one direct pressure operable self contained disparate hydraulic source condition adapter composite and/or at least one relief valve operable self contained disparate hydraulic source condition adapter composite (12).

In addition, as will be discussed in more detail below, one of the current inventive technologies features is that is may include an accommodated external system self-contained disparate hydraulic source condition adapter composite (13) such that it may freely and automatically accommodate multiple hydraulic systems, such as an open-centered and closed-centered, individually, and/or simultaneously without operator intervention or adjustment.

In one embodiment, the inventive technology may relate to an adaptable hydraulic control system or a hydraulic control system with a hydraulic innervator control valve (5), controlled by a series of switches that may communicate with the hydraulic innervator control valve (5), and may innervate at least one, perhaps multiple direction actuator responsive to said hydraulic innervator control valve (6), or an actuator, at both low and high pressures and/or variable flow volumes consistent with open-centered and closed centered hydraulic systems.

Figure 2:
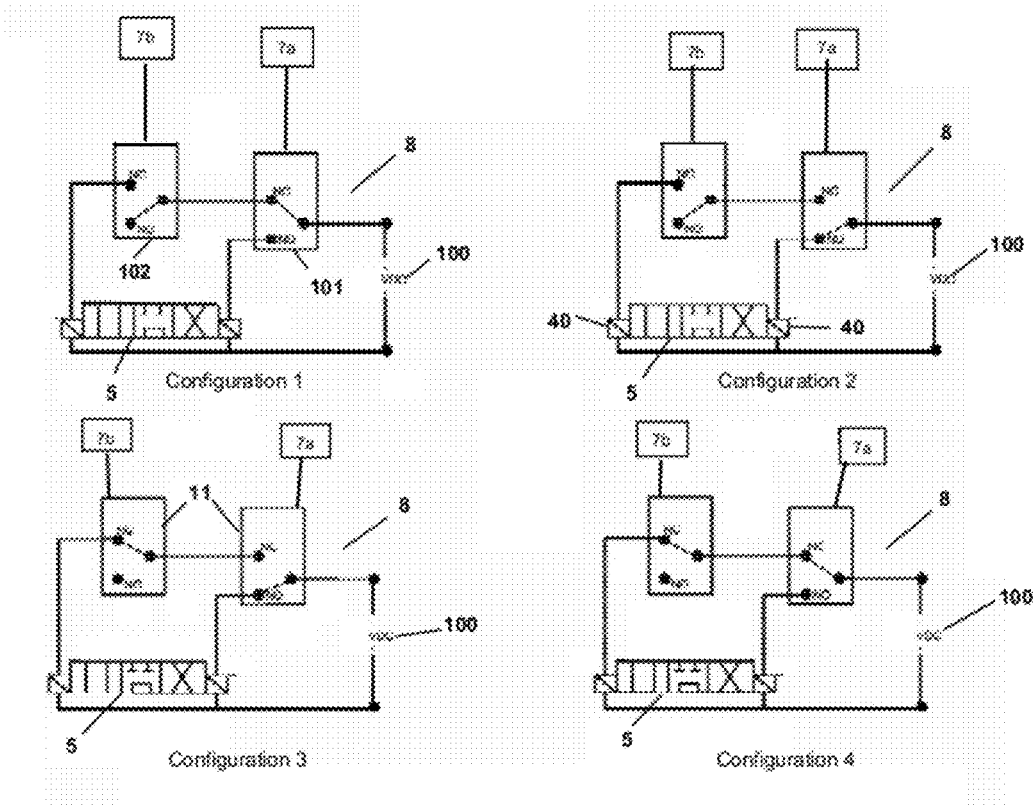
FIG. 2—Depicts a self contained, possibly disparate hydraulic source condition adapter composite in another exemplary embodiment.

Embodiments of the current inventive technology may be understood through the initial embodiment of a self contained disparate hydraulic source condition adapter composite (8) for control of hydraulic system shown in FIGS. 1 and 2 generally. This type of system may include the elements of an electrical power system, perhaps as shown in FIGS. 1 and 2 conceptually as a 12 VDC power connection and/or battery, which may in fact be any suitable power source (100) capable of generating an electrical signal, such as a generator, alternator, electrical or other appropriate power source.

Referring to FIGS. 1 and 2, embodiments of the current inventive technology may include a plurality of adaptively interconnected switches, which may in some embodiments or in some configurations include a plurality of disparately configured switches, which as will be discussed below, may include, for example perhaps four switch configurations (28) as shown in FIG. 2 respectively. Still further embodiments may include at least one series of paired switches. Such switches generally may include any suitable device capable of receiving an electrical, or mechanical signal and either interrupting, transforming, or transmitting a signal, or any combination thereof. In some embodiments as shown in FIGS. 1 and 2, each switch may include a combination of diverted and/or series paths for each switch (29) which may interrupt, or complete an electrical circuit with a power connection or battery. In some embodiments, such a combination of diverted and/or series paths may include a first switch feed through configured with a second switch diversion configured; a first switch diversion configured with a second switch diversion configured; a first switch diversion configured with a second switch feed through configured; and a first switch feed through configured with a second switch feed through configured (30). The dynamic interchanging of these configurations may result in the desired adaptation, or innervation of separate elements of a self contained disparate hydraulic source condition adapter composite (8).

As discussed previously, additional embodiments of such a self-contained disparate hydraulic source condition adapter composite (8) may include a hydraulic innervator control valve (5). Such a valve may include any suitable device that allows the flow of fluid in a plurality of directions, or under varying conditions or constraints perhaps from a pump fluidically capable of displacing at least some of said hydraulic fluid (1*b*) or pump, or adjustable pump to a single, or plurality of actuator elements.

Further embodiments of such a hydraulic innervator control valve (5), may include multiple hydraulic innervator control valves (19) as shown generally in FIG. 1. In still further embodiments, such multiple hydraulic innervator control valves (19) may include multiple substantial identical innervator control valves (20), again as generally referenced in FIG. 1. Again referring to FIGS. 1 and 2, in some embodiments these multiple substantial identical innervator control valves may include multiple series paired switches which, as will be discussed in more detail below, may be functionally coordinated with one or more of said hydraulic innervator control valves.

Again, referring generally to FIGS. 1 and 2, a hydraulic innervator control valve (5) may act in response to an appropriate electrical or mechanical signal, and may be able to freely interchange position(s), as discussed by the innervation/action of at least one hydraulic innervator control valve power control (9). In some embodiments, such a hydraulic innervator control valve power control (9) may include at least one dual valve movement element (40) coordinated on opposing sides of a hydraulic innervator control valve (5).

Embodiments of such a hydraulic innervator control valve (s) (5), as shown in FIGS. 1 and 2, may include multiple disparate three part valve(s) (23). In some embodiments such a multiple disparate three part valve may include a single dynamic assembly forming a tripartite configured hydraulic innervator control valve (41), which may have a $1^{st}$ configuration (forward flow), a $2^{nd}$ configuration (backward flow) and/or a neutral configuration (42) in a single dynamic assembly. Additional embodiments may include discrete coordinated power-valve configurations allowing for the controlled movement of a hydraulic innervator control valve(s) (5). In some instances, as shown in FIG. 2, such coordinated power-valve configurations may include a tripartite configurable hydraulic innervator control valve with a first and a second power control input, wherein said first configuration comprises a powered first power control input and an unpowered second power control input, and said second configuration comprises a unpowered first power control input and a powered second power control input, and said neutral configuration comprises an unpowered first power control input and an unpowered second power control input (43).

Additional embodiments, shown generally in FIGS. 1 and 2, may include at least one hydraulic innervator control valve power control (9), and may further include a dual valve movement element (40*b*), which may include consistent with the above discussion, a $1^{st}$ configuration, a $2^{nd}$ configuration and/or a neutral configuration. In some embodiments, for example a hydraulic innervator control valve power control (9), that may include a dual valve movement element (40*b*), may be configured so as to have a first and a second power control input, and wherein said first configuration comprises a powered first power control input and an unpowered second power control input, said second configuration comprises an unpowered first power control input and a powered second power control input, and said neutral configuration comprises an unpowered first power control input and an unpowered second power control input (43). These valve-power configurations allow for the electrical control and selection of the positional configuration of a hydraulic innervator control valve(s) (5).

In some embodiments, such multiple disparate hydraulic innervator control valve(s) may be selected from a group consisting of: at least one normally closed innervator control valve; and at least one normally open innervator control valve (22). Examples of such multiple disparate hydraulic innervator control valves may include for example a multiple disparate three part valve, as shown in FIGS. 1 and 2, having at least one forward valve (or forward flow position), at least one backward valve (or backward flow position), and/or at least one dual disparate neutral valve (or neutral flow position).

Referencing FIGS. 1 and 2, a hydraulic innervator control valve (5) may act in response to an appropriate electrical or mechanical signal and may be able to freely change, perhaps by the innervation of at least one valve movement control element (40) coordinated perhaps with a hydraulic innervator control valve (5) between one of perhaps three fluid flow valve positions, such as a forward, backward, or open-neutral position. In the forward and/or backward flow position, hydraulic fluid from a pump may flow across the valve to at least one multiple direction actuators responsive to said hydraulic innervator control valve (6) or an actuator. Such an actuator element may include any single, or plurality of elements that activate a mechanical device, perhaps such as a hydraulic piston. In the open-neutral position, fluid from the pump may flow continuously through the neutral-position to a reservoir, creating a continuous flow of fluid that may be typical of an open-centered hydraulic system.

In some embodiments of the current inventive technology, a hydraulic innervator control valve (5) may be coordinated with at least one hydraulic innervator control valve power control (9) or flow control valve movement element. In this embodiment, the hydraulic innervator control valve (5) may be coordinated with two opposing hydraulic innervator control valve power controls (9), which may be further designated flow control valve movement elements A and B respectively. In this embodiment, each flow control valve movement element may, in response to an appropriate electrical or mechanical signal, cause the selection of an appropriate hydraulic innervator control valve(s) (5) position. Again, in this particular embodiment, the three positions can be seen as being the forward, backward and an open-neutral flow position. Convenient to this embodiment is a hydraulic innervator control valve (5) design that, in the absence of any appropriate signal, may re-set to an open-neutral position.

Some embodiments of the current inventive technology may further include a plurality of adaptively interconnected switches (10) as shown generally in FIGS. 1 and 2. As discussed previously, certain embodiments of the current inventive technology may include an electrically switched hydraulic control system which may include but not limited to: a reservoir configured to contain a hydraulic fluid (1*a*); a pump fluidically capable of displacing at least some of said hydraulic fluid (1*b*); a transmission line fluidically responsive to said pump (2); a connector element (4); a hydraulic innervator control valve (5); at least one multiple direction actuator responsive to said hydraulic innervator control valve (6); and at least one movement trigger element (7); at least one paired series interconnect switch assembly to which said hydraulic innervator control valve is responsive (45).

Referring to FIG. 2, some embodiments of a paired series interconnect switch assembly to which said hydraulic innervator control valve is responsive (45), may include at least one paired inter-adaptively inter-operative switch assembly which may, as indicated include a series of switches appropriately coordinated with, a power source and in this example at least two hydraulic innervator control valve power controllers (9) attached to a hydraulic innervator control valve (5). Such a switch, or series of switches may include any devices that can accept, or sense an appropriate electrical, or mechanical signal, then transform, transmit, or interrupt said electrical or mechanical signal. Additional embodiments may include a plurality of disparately configured switches (47) as shown generally in FIG. 2. Referring now to FIG. 1, still further embodiments may include a series of paired switches that may accommodate numerous configurations. As one skilled in the art can appreciate various embodiments of this invention positional may include a plurality of switches, in series or parallel, or any combination or sub-combination coordinated with an appropriate electrical or mechanical signal and perhaps a plurality of appropriate innervator control valve power controller(s) (9) attached to a hydraulic innervator control valve(s) (5) or other devices. In some instances, as specifically references in FIG. 2, some embodiments may include, for example approximately at least four switch configurations (50). Certain configurations, namely switch configuration 3, may include at least one transiently dormant reconfigured switch assembly (49).

Again referring to FIGS. 1 and 2, it can be appreciated that each switch may include, for example at least three input or output positions, generally referred to as ground, normally open (NO) and normally closed (NC), such that there may exist a combination of diverted (not active) and/or series (active) paths among these positions for each switch. In some embodiments such a combination of diverted and/or series paths may include but not be limited too:

- a first switch feed through configured with a second switch diversion configured;
- a first switch diversion configured with a second switch diversion configured;
- a first switch diversion configured with a second switch feed through configured; and
- a first switch feed through configured with a second switch feed through configured (51)

Again referring to FIGS. 1 and 2, in some embodiments of a paired series interconnect switch assembly to which said hydraulic innervator control valve is responsive (45), may include for example a power connection connected to a first switch input; a first switch first output connected to a second switch input; a first switch second output connected to a hydraulic innervator control valve power control first input; and a second switch first output connected to a hydraulic innervator control valve power control second input (53). As can be generally appreciated, numerous configurations may be included in the current invention as shown and contemplated.

In one embodiment, the power source shown as a power connection or battery, switch elements, and hydraulic innervator control valve power control or flow control valve movement elements designated A and B respectively may be appropriately connected through a signal connector element. A signal connector element in this embodiment may include any material that can transmit an appropriate electrical or mechanical signal between elements.

In one embodiment, the position of a hydraulic innervator control valve (5), whether it is in the forward, backward or open-neutral flow position may be controlled by the interaction of a series of switch configurations, and coordinated with each individual flow control movement element(s), and an appropriate power source, in this case shown as a battery. This control may be achieved by the coordinated configuration changes in the switch elements and corresponding hydraulic innervator control valve (5), that allows for an appropriate signal to travel from the battery, perhaps to one of the two control-flow movement elements.

Control can be understood through various dynamic configuration changes. In some embodiment as shown in FIG. 2, an initial state is shown as electrical circuit configuration 1, where a battery may be utilized, through an input or output position or connector perhaps designated a ground position (which may be an arbitrary designation on switch #2). The ground position on switch #2 may be coordinated with a connector perhaps to a "normally closed" position, labeled as the NC position on switch #2. The NC position on switch #2 may be coordinated with a connector to the "ground" position (again, this may be an arbitrary designation) on switch #1 as shown in FIG. 2. The ground position on switch #1 may be coordinated with a connector, perhaps to a "normally open" position, labeled as the NO position on switch #1. In addition, the NO position on switch #2 may be connected, by a connector to the flow control valve movement element B. The NC position on switch #1 may be connected, by a connector to the flow control valve movement element A. Both flow control valve movement elements A and B may be connected, by a connector (such as a wire) to a battery, or the electrical circuit in general. In this configuration, designated circuit configuration 1, no electrical circuit is completed between any of the elements, no power is supplied to the hydraulic innervator control valve(s) (5), and the hydraulic innervator control valve(s) (5) remains, or defaults to the open-neutral position. In this configuration the hydraulic fluid from the pump passes through the open-neutral position of the hydraulic innervator control valve(s) (5) and returns back to the reservoir without doing any work or activating any actuator. This flow may be continuous and at a uniform volume and pressure.

FIG. 2 depicts a second electrical circuit configuration. In this embodiment it can be understood that circuit configuration 1 described above is maintained until an external force is applied to a sensor coordinated with switch #2. This triggering may cause a change to circuit configuration 1 and switch #1 (101). The external force that may act on a movement trigger element or sensor (7), which may in some embodiment include a single, or plurality of directly or indirectly coordinated position sensor(s). Such a movement trigger element or sensor (7), for example, in some embodiments may include a position sensor, which may further include any sensor that may sense an external force, or signal, mechanical or electrical, that is sufficient to activate movement trigger element (7). A movement trigger element (7), or position sensor (or sensor), may include any device capable to receiving an appropriate signal and transmitting it, transfiguring it, or interrupting that signal as well as initiating at least one triggered switch reconfiguration, as will be described in more detail below. In particular, as shown in FIGS. 1 and 2, in some embodiments, a switch may be coordinated with a particular sensor, in some embodiments perhaps mechanically or electrically, In this embodiment a position sensor is shown. For example, switch #1 is coordinated with position sensor #1 (7*a*), and switch #2 is coordinated with position sensor #2 (7*a*). Further, as shown in FIG. 1, in another embodiment, switch #3 is coordinated with position sensor #3 (7*c*), while switch #4 is coordinated with position sensor #4 (7*d*). As described herein, the dynamic interaction of such switches, position sensors with the various hydraulic elements allow for the novel dynamic control of such system. It should also be noted that the operation of a position sensors may include innervation by perhaps movement of a object triggering the sensor, or removal of an object from, of relief of pressure or contact of an object from one or more position sensors causing a return or non-innervation of said position sensor.

Figure 3:
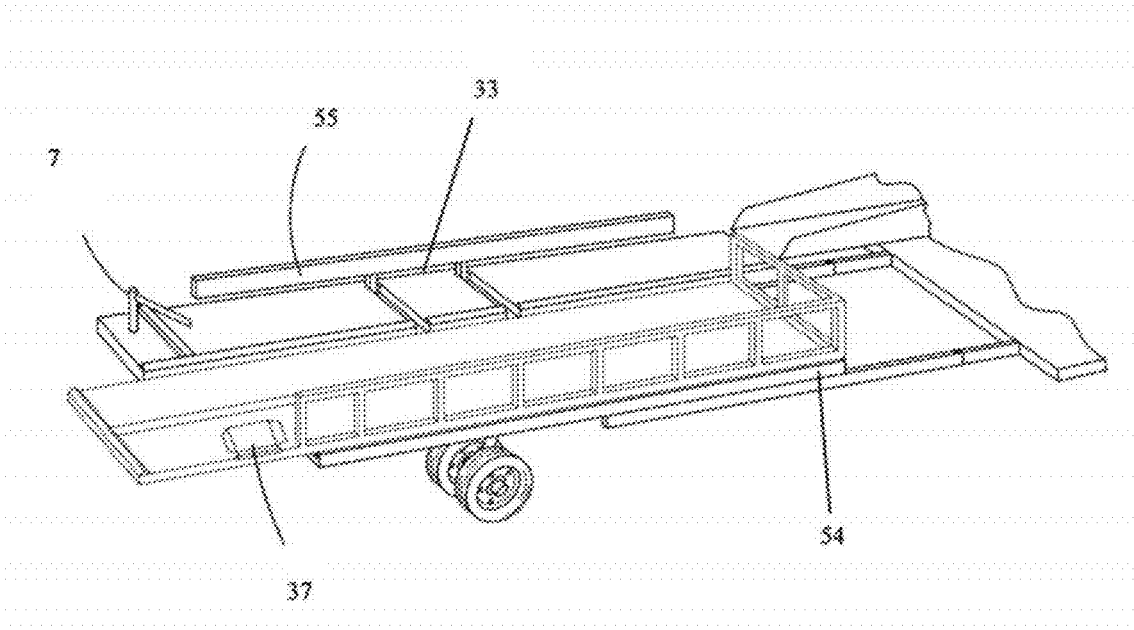
FIG. 3—Depicts a perspective view of a bale accumulator in an exemplary embodiment with no bales disposed thereon.

An embodiment of this configuration is shown in FIG. 3, as described in the exemplary context of a hydraulic mechanism for receiving bales of agricultural materials, in this case hay on a receiving bed, as more particularly described in US Patent Publication 2008/0095597 filed on Dec. 14, 2007, entitled Bale Handling and Accumulator System hereby incorporated in its entirety by reference.

In this exemplary embodiment, a receiving bed may include any device sufficient to support a plurality of bales from an attached baler. In one exemplary embodiment, for example as a plurality of bales, or other objects or forces may be loaded onto the receiving bed, each extending further down the length of the receiving bed until the bales eventually reach the end of the receiving bed and trigger, or activate a movement trigger element (7), which may in some embodiment include a position sensor. In this exemplary embodiment a first position sensor is triggered. Activation of a first position sensor on the receiving bed (or any other apparatus) may cause, for example a triggered switch reconfiguration where the connector coordinated between the ground position and the NC position on switch #2 to now dynamically reconfigure to be connected from the ground position to the NO position on switch #2. This reconfiguration among switch positions may establish a circuit path or series path from the battery, through the ground position of switch #2 to the NO position and flow control valve movement element B. The completion of this circuit, or series path may cause the flow control valve movement element B to move the hydraulic innervator control valve(s) (5) into the forward position. The hydraulic fluid may then be freely flow through the hydraulic innervator control valve(s) (5) forward position to an actuator. The flow of fluid may cause the extension or other multiple directional action of an actuator. In this current exemplary embodiment, a spring-loaded actuator arm element (55) may extend pushing the hay bales in a laterally orientated direction across the receiving bed. It should be understood, that some embodiments may include at least one multiple direction actuator responsive to said hydraulic innervator control valve (6). Additional embodiments of such a multiple direction actuator may include, for example, a plurality of bi-directional piston elements (34), while still further embodiments may include a $1^{st}$ and $2^{nd}$ hydraulic bi-directional piston elements.

As can be appreciated by one skilled in the art, the current inventive technology may, for example be adapted to provide an adaptable hydraulic control for an open-centered and/or closed-center systems as previously discussed through a self contained disparate hydraulic source condition adapter composite, which in some embodiments may include a single component functionable self contained disparate hydraulic source condition adapter composite; and perhaps a multiple component functionable self contained disparate hydraulic source condition adapter composite. In some embodiments such multiple components may be of varying combinations of open-centered and closed-centered hydraulic apparatus or devices that may be coordinated, adapted to, and/or singly controlled by the current inventive technology whether automatically, or through an operator control or interface.

FIG. 2 depicts at least one transiently dormant reconfigured switch assembly (11) identified as electrical circuit configuration 3. In this embodiment it can be understood that electrical circuit configuration 2, as described above may be maintained until movement occurs, or perhaps until an external force is either relieved or applied to another movement trigger element (7), perhaps a second position sensor coordinated with switch #1. In this embodiment, as an actuator begins to move and extend the bales laterally across the receiving bed, at least one pressure release trigger (33) may be relieved from a second position sensor located on the underside of the receiving bed by the initial movement of the actuator. Since a movement trigger element (7) such as a second position sensor may be coordinated with switch #1, activation of the second position sensor from the release of pressure caused by the extension of the actuator may cause the connector from the ground position on switch #1 to reconfigure from the NO position to the NC position of switch #1. It may be noted that this inactive or dormant switch reconfiguration (31) may have no immediate effect because switch #2 has an electrical pathway or circuit established from its ground position to its NO position, however, this operation of switch #1 may create a needed transiently dormant electrical pathway for later operation as described below.

FIG. 2 depicts a fourth electrical circuit configuration. In this embodiment it can be understood that electrical circuit configuration 3, as described above may be maintained until movement occurs, or perhaps until an external force is either relieved or applied to another sensor, perhaps the first position sensor, coordinated with switch #2. As may be understood, circuit configuration 3 is maintained, until the external force placed on the first position sensor from the actuator for example by pushing the bales laterally, is relieved by the bale sliding off of the first position sensor as it is pushed to its next bed location. This is accomplished by the lateral movement of the actuator extending the bales past the first position sensor causing it to return to its original state. The return of the first position sensor to its original state causes the connector configured from the ground position on switch #1 to the NO position on switch #2 to return to its original, or perhaps default configuration connecting the ground position to the NC position of switch #2. The return of switch #2 to its original position now establishes a series path or circuit from the battery, to flow-control valve element A, by the previously established connection of the ground position of switch #1 to the NC position on switch #1. Thus a series path or competed electrical pathway from the battery, through switch #2, into and through switch #1 is established. The completion of this electrical circuit may end a transiently dormant state in that it can cause the flow control valve movement element A to move the hydraulic innervator control valve (5) into the backward flow position. The hydraulic fluid is then free to flow through the hydraulic innervator control valve(s) (5) backward flow position to the actuator. This flow of fluid causes the retraction of the actuator until the next circuit configuration occurs.

FIG. 2 depicts the next electrical circuit configuration, namely that of the original first circuit configuration. In this embodiment, it can be understood that electrical circuit configuration 4, as described above may be maintained until movement occurs, or perhaps until an external force is either relieved or applied to another sensor, perhaps the second position sensor, coordinated with switch #1.

In this embodiment, when the actuator returns to its original position, it places pressure on for example a movement trigger element (7), in this exemplary embodiment a second position sensor activating it. Activation of this second position sensor may cause switch #1 to return to circuit configuration 1, where the NO position on switch #1 may be established by a connection with the ground position on switch #1. This action may break or divert the electrical circuit previous established in circuit configuration 4. By returning to the original circuit configuration, no active electrical pathway (diverted state) exists from the battery through switch #1, or switch #2 or to either of the flow-control valve movement elements. In this diverted state, the hydraulic innervator control valve (5), by its default, may return to the open-neutral position and fluid from the pump may pass through the open-neutral valve position on the hydraulic innervator control valve (5) and return to the reservoir without doing any work or actuating any piston or the like. In this embodiment, the return of the hydraulic innervator control valve(s) (5) to the open-neutral position may be accomplished perhaps by a spring-loaded centering mechanism. In other embodiments, any appropriate mechanism or device can be used to center the hydraulic innervator control valve(s) (5) into the center neutral position or otherwise return it to the desired position as one of ordinary skill in the art would readily appreciate.

Figure 4:
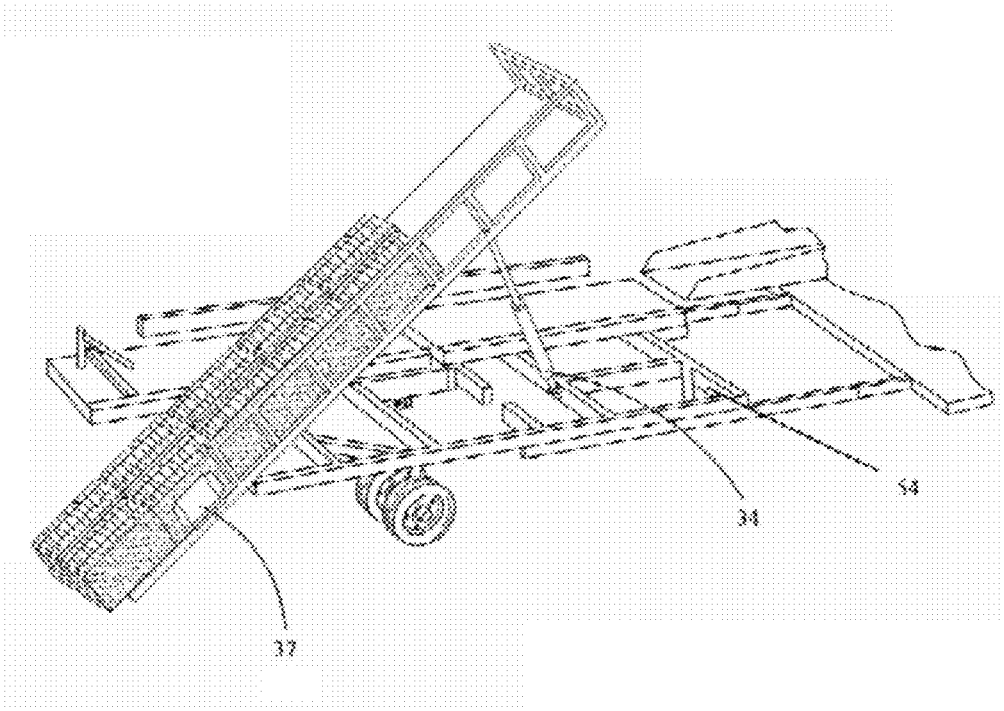
FIG. 4—Depicts a perspective view of a bale accumulator in an exemplary embodiment having a tiled bale reception surface with multiple in-line bale rows disposed thereon.

Another aspect of the invention may be the inclusion of one or more additional hydraulic circuits, electrical circuits, or switches as previously described. Use of a second hydraulic and a second electrical circuit is generally depicted in FIG. 1. As can be seen from the figure, embodiments may include a second series switching system which may be utilized for adaptation and/or control of another, possibly even disparate hydraulic system. In this further embodiment, the actuator operated by this second series switching system may be a hydraulic system unique from the first, and may act to perform a distinct movement or series of movements. As shown in FIG. 4, in this further exemplary embodiment the lateral movement of the hay bales across the receiving bed may trigger or activate another movement trigger element (7), for example a third position sensor. This third position sensor may be analogous to the first position sensor in that its activation causes the transformation from circuit configuration 1, to circuit configuration 2 in a second series switching system or a plurality of adaptively interconnected switches. In this embodiment, the creating of such a circuit, as discussed above may activate a flow-control valve movement element causing it to shift to a forward position. The flow of hydraulic fluid through a second hydraulic innervator control valve(s) (5) in the forward position may cause the extension or other movement/action of a second actuator. In this exemplary embodiment a second actuator may extend upward, lifting a portion of the receiving bed causing the bales to slide off the receiving bed onto the ground. In this embodiment, an additional movement trigger element (7) such as a fourth position sensor (54) may be activated by the tilt of the receiving bed, or in other embodiments by the movement of the bales off the receiving bed. Activation of this fourth position sensor may cause the reconfiguration or transformation for example from circuit configuration 2 to circuit configuration 3 in a second series switching system.

In this further embodiment, as the bales are transferred off the receiving bale, the signal may be removed from the third position sensor, causing the circuit configuration of the second series switching system, to change or reconfigure from circuit configuration 3 to circuit configuration 4. Analogous to the first described embodiment, this may cause the movement of a second hydraulic innervator control valve (5) to a backward flow position, allowing pump-flow to pass through the backward flow position on the hydraulic innervator control valve (5) to the actuator, causing the actuator to go in the opposite direction, and in this exemplary example, lower the receiving bed. As the receiving bed is lowered, the activation signal for the fourth position sensor is removed causing the circuit configuration of the second series switching system to change from circuit configuration 4, back to circuit configuration 1, or return. In this state, no active series paths circuits are present between a battery, switch #3 and/or switch #4, (exemplary of a diversion or diversion path and also an unpowered state) to act on the second hydraulic innervator control valve (5) as shown. As a result, in this embodiment the second hydraulic innervator control valve (5) may return to the open-neutral position, and fluid from the pump passes through the open-neutral valve position and returns to the reservoir without doing any work, or activating any actuator, piston or the like. In this embodiment, the return of the hydraulic innervator control valve (5) to the open-neutral position may be accomplished by perhaps a spring-loaded centering mechanism within the second hydraulic innervator control valve (5) as described for the first hydraulic innervator control valve (5) above.

In addition, it would be naturally obvious to one skilled in the art that any single or combination or sub-combination, in series or parallel of elements including batteries, sensors, circuits, connectors, power circuit boxes, hydraulic innervator control valve(s) (5), flow-control valves movement elements, and actuators and the like herein described can be utilized in a plurality of configurations, with multiple apparatus to create a dynamic adaptable hydraulic control system, with series or parallel combinations of actuators performing a variety of mechanical actions. Additionally, in further embodiments, the elements may be coordinated through a circuit box in a plurality of combinations and arrangements.

In addition, further embodiments may include manual or automatic overrides of a plurality of sensors. In still a further embodiment, said overrides can be programmable and/or operator engageable.

The invention may also include another aspect, either completely independently or in conjunction with the above design (s). As discussed previously there has been a long-felt need for an innovation that can self-containedly integrate successfully with both an open-center and closed-center hydraulic system. The inventive technology described herein may allow a user to simply attach said adaptable hydraulic control system to either an open-centered or closed-center tractor or more generally hydraulic system. A typical open-center hydraulic system may not include a shunt relief valve, while a typical closed-center hydraulic system may include this, or other similar relief valves. The inventive technology in some embodiments may allow for at least one relief valve (14) to be used in conjunction with an open-center hydraulic innervator control valve(s) (5). In some embodiments the use of a relief valve (14) may maintain an appropriate pressure and/or flow volume between the typically high pressure of a closed-center system, and the low-pressure typically used in an open-centered system. For example, many high pressure or closed center systems may operate at approximately 2850 psi when in an active, working state. By contrast, many relatively low pressure, or open-center systems may operate at approximately one-tenth that amount, or about 300 psi in a continuously flowing state. Naturally, these pressures may vary such as to use, or establish low pressures of below about 200 psi, 250 psi, 300 psi, 350 psi, 400 psi, 450 psi, or even about 500 psi. Similarly, these pressures may vary such as to use, or establish high pressures of above about 2000 psi, 2500 psi, 3000 psi, 3500 psi, 4000 psi or above. The addition of a relief valve (14) to embodiments of this inventive technology may act to maintain, regulate, and/or create the system's pressure and/or flow volumes at an intermediate level and may allow for the interchangeable operation with a closed-center, or an open-center hydraulic system. This intermediate pressure may be established for only a high pressure or perhaps closed-center system at a level intermediate from its normal higher pressures, such as about 700 psi, 800 psi, 850 psi, 900 psi, 1000 psi, about 1200 psi, about 1300 psi, about 1400 psi, about 1600 psi, and about 1800 psi as described below. Naturally these may all be relationally determined with respect to the percentage of high or low pressure involved, or any combination of these.

Figure 5:
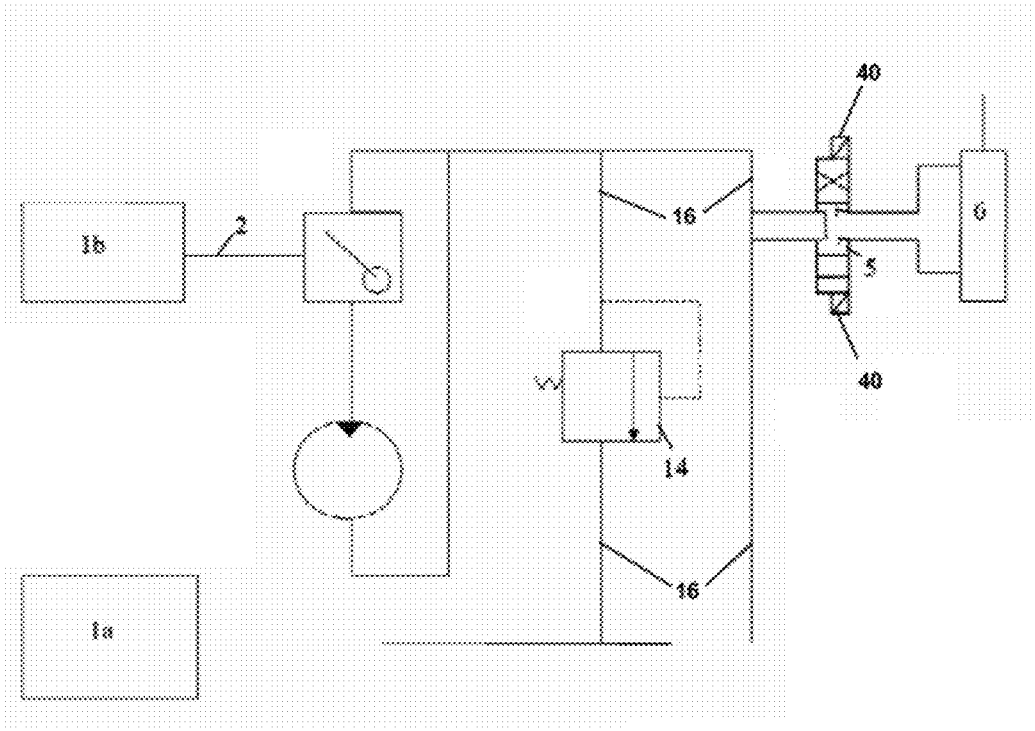
FIG. 5—Depicts a hydraulic schematic for an adaptable hydraulic control system.

One embodiment, of such as system is shown in FIG. 5 may include a transmission line (or line) fluidically responsive to said pump (2). In some embodiments such a line may be (1*b*) attached to a shunt or relief valve (14). Such a line may include any device that can transmit fluid, or perhaps alter pressure within a hydraulic system. A relief valve (14) may include any appropriate relief valve having an intermediate range of pressure sensitivity from greater than a typical low pressure, to less than a typical high pressure. Other embodiments may include a flow control coordinated self contained disparate hydraulic source condition adapter composite (18) or adjustable flow control (56) which may be manually adjusted, initially, or even empirically set to suit a desired operational results such as speed of operation. Further, some embodiments may include a slower operational accommodated external system self contained disparate hydraulic source condition adapter composite (15) where for example speed of operation may be an intermediate speed such that while operating a faster rate with a closed-center system, as compared to an open-center system it is not significantly discernibly different from an operators viewpoint. For example, the system may operate in about 4, 5, or about 6 seconds with an open-center system, and may operate in about 2, 3, or about 4 seconds when an open-center system is powering it perhaps by the motor. Some embodiments may include a multiple parallel shunt capability accommodated external system self-contained disparate hydraulic source condition adapter composite (16) as referenced in FIG. 5. Further referenced in FIG. 5, additional embodiments may include, for example at least one intermediate flow primary shunt (17), again referenced in FIG. 5.

In one embodiment, as shown in FIG. 5, a relief valve (14) may be a shunted relief valve, such that it may connect input and output lines by perhaps bridging or shunting the involved hydraulic system as shown. This shunted relief valve may include a range of pressure sensitivities from about 1 psi to about 5000 psi. A further embodiment may include a spring-loaded needle shunted relief valve which may be set to a pressure sensitivity of about 850 psi with a shunt line being connected to the a fluid reservoir and another line being connected to a hydraulic innervator control valve (5). Further embodiments may include a motor coordinated with a line to a flow control coordinated self contained disparate hydraulic source condition adapter composite (18) or adjustable flow control (56).

In one embodiment as shown in FIG. 5, when a hydraulic innervator control valve (5) is in the center position, fluid from the pump (1*b*) may flow through a line to the a hydraulic innervator control valve (5) and back to a reservoir configured to contain a hydraulic fluid (1*a*) or fluid reservoir. In this embodiment, when the hydraulic innervator control valve (5) is in the forward, or backward flow position, fluid from an a pump fluidically capable of displacing at least some of said hydraulic fluid (1*b*) or pump may flow through a transmission line fluidically responsive to said pump (2), a connector element (4) to the a hydraulic innervator control valve (5) and into at least one multiple direction actuator responsive to said hydraulic innervator control valve (6) (or actuator) In this embodiment, and especially or perhaps only for a closed-center system, the relief valve may maintain the pressure and flow volume in the system at a pre-determined, perhaps intermediate level depending on the sensitivity or setting of a relief valve (14). This may occur by shunting flow through the shunt pathway shown so only an intermediate amount of flow, or perhaps even a typical low pressure amount is maintained for, or at the piston or other actuator.

In addition, it would be naturally obvious to one skilled in the art that further embodiments may include a plurality of relief valve(s) (14) in a variety of combinations or sub-combinations with a plurality of pressure sensitivities. These further embodiments may include a single or plurality of overrides coordinated with said relief valve(s) (14). In some embodiments a single relief valve (14) may be coordinated by hydraulic transmission lines or lines to a single or plurality of hydraulic innervator control valve(s) (5). In other embodiments, a plurality of relief valve(s) (14) may be coordinated by lines to a single or plurality of hydraulic innervator control valve(s) (5) as discussed previously with such embodiments such as a multiple parallel shunt capability accommodated external system self contained disparate hydraulic source condition adapter composite (16) as well as perhaps at least one intermediate flow primary shunt (17) as referenced in FIG. 5.

As can be easily understood from the foregoing, the basic concepts of the present invention may be embodied in a variety of ways. It involves both hydraulic system control techniques as well as devices to accomplish the appropriate hydraulic system control. In this application, the hydraulic system control techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this non-provisional application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "switch" should be understood to encompass disclosure of the act of "switching"—whether explicitly discussed or not—and, conversely, were there effectively disclosure of the act of "switching", such a disclosure should be understood to encompass disclosure of a "switch" and even a "means for switching." Such changes and alternative terms are to be understood to be explicitly included in the description.

Any patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Patent Application or other information statement such as an information disclosure statement filed with the application or priority documents are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the hydraulic devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim v. Cannon Avent Group, PLC,* 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like. As one clarifying example, if a claim were dependent "on claim 20 or any other claim" or the like, it could be re-drafted as dependent on claim 1, claim 15, or even claim 715 (if such were to exist) if desired and still fall with the disclosure. It should be understood that this phrase also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A hydraulic control system comprising:

a reservoir configured to contain a hydraulic fluid connected with a pump fluidically capable of displacing at least some of said hydraulic fluid through a transmission line fluidically responsive to said pump;

at least one actuator connected with said transmission line through a hydraulic control valve;

an automatic hydraulic controller connected with said hydraulic control valve having:

a power source electrically connected with at least a first and a second switch in series connected with a hydraulic control valve through at least one electrical connection; and at least one position sensor connected with at least one switch such that innervation and/or de-innervation of said position sensor activates dynamic reconfiguration of said switch;

wherein said first and a second switches in series dynamically reconfigure to a transient dormant configuration such that said second switch is reconfigured from an open position (NO) to a closed position (NC) while said first switch maintains an open position interrupting the input to said second switch so as to prepare for a subsequent step of switching said first switch to an closed position thereby energizing said second switch and activating said hydraulic control valve toward a new position.

2. A hydraulic control system as described in claim 1 wherein said hydraulic controller comprises a hydraulic controller selected from the group consisting of:

an electric hydraulic controller; a manual hydraulic controller; and a semi-automatic hydraulic controller.

3. A hydraulic control system as described in claim 1 and further comprising at least one valve movement control element connected with said hydraulic control valve.

4. A hydraulic control system as described in claim 3 wherein said valve movement control element connected with said hydraulic control valve comprises a solenoid.

5. A hydraulic control system as described in claim 1 wherein said hydraulic control valve comprises a tripartite hydraulic control valve having a forward flow position, a backward flow position, and a neutral flow position.

6. A hydraulic control system as described in claim 5 wherein said tripartite hydraulic control valve comprises a tripartite hydraulic control valve having a first and a second valve movement control element, and wherein a first configuration comprises a powered first valve movement control element and an unpowered second movement control element, a second configuration comprises an unpowered valve movement control element and a powered second valve movement control element, and a neutral configuration having an unpowered first valve movement control element and an unpowered second valve movement control element.

7. A hydraulic control system as described in claim 1 wherein said first and second switches in series connected with a hydraulic control valve comprise:

a power connection connected to a first switch input;

a first switch first output connected to a second switch input;

a first switch second output connected to a valve movement control element first input; and a second switch first output connected to a valve movement control element second input.

8. A hydraulic control system as described in claim 1 wherein said first and second switches have four switch configurations.

9. A hydraulic control system as described in claim 8 wherein said first and second switches are connected to first and second position sensors, respectively, such that such that the four configurations are sequentially activated by sequential activation of the respective positions sensors.

10. A hydraulic control system as described in claim 9 wherein said first and second switches are connected to first and second position sensors, respectively, such that four configurations are sequentially activated by sequential activation of the respective positions sensors comprises a combination of diverted and/or series paths for each switch comprising:

a first switch feed through configured with a second switch diversion configured;

a first switch diversion configured with a second switch diversion configured;

a first switch diversion configured with a second switch feed through configured; and a first switch feed through configured with a second switch feed through configured.

11. A hydraulic control system as described in claim 1 and further comprising at least one relief valve connected to said transmission line so as to shunt hydraulic fluid preceding said hydraulic control valve to facilitate variable flow volumes.

12. A hydraulic control system as described in claim 1 wherein said hydraulic control valve comprises an open or closed center hydraulic control valve.

13. A hydraulic control system as described in claim 1 and further comprising at least one shunted hydraulic pathway connecting said fluid reservoir and said pump preceding said hydraulic control valve.

14. A hydraulic control system as described in claim 13 wherein said shunted hydraulic pathways comprises at least one intermediate pressure flow primary shunted hydraulic pathway connected with said fluid reservoir and said pump preceding said hydraulic control valve.

15. An electrically switched hydraulic control system comprising:

a reservoir configured to contain a hydraulic fluid connected with a pump fluidically capable of displacing at least some of said hydraulic fluid through a transmission line fluidically responsive to said pump;

at least one actuator connected with said transmission line through a hydraulic control valve;

an electrically switched hydraulic controller connected with said hydraulic control valve having:

a power source electrically connected with a pair of first and second interconnected electrical switches in series electrically connected with a hydraulic control valve through at least one electrical connection; and at least one position sensor connected with at least one of said paired electrical switches such that innervation and/or de-innervation of said position sensor activates dynamic reconfiguration of said switch wherein said first and second switches in series dynamically reconfigure to a transient dormant configuration such that said second switch is reconfigured from an open position (NO) to a closed position (NC) while said first switch maintains an open position interrupting the input to said second switch so as to prepare for a subsequent step of switching said first switch to an closed position thereby energizing said second switch and activating said hydraulic control valve toward a new position.

16. An electrically switched hydraulic control system as described in claim 15 and further comprising a plurality of valve movement control elements connected with a corresponding hydraulic control valve also being electrically connected with a corresponding interconnected paired electrical switch in series.

17. An electrically switched hydraulic control system as described in claim 15 wherein further comprising a second pair of first and second interconnected electrical switches in series connected with a second hydraulic control valve.

18. An electrically switched hydraulic control system as described in claim 17 wherein said single series electrical switch assembly connected with a plurality of hydraulic control valves comprises a combination of diverted and/or series paths for each electrical switch sequentially reconfigured by innervation and/or de-innervation of at least one position sensor connected with at least one switch such that innervation and/or de-innervation of said position sensor activates dynamic reconfiguration in a corresponding switch.

19. An electrically switched hydraulic control system as described in claim 18 wherein said combination of diverted and/or series paths for each electrical switch sequentially reconfigured by innervation and/or de-innervation of at least one position sensor connected with at least one switch comprises:

a first electrical switch feed through configured with a second electrical switch diversion configured;

a first electrical switch diversion configured with a second electrical switch diversion configured;

a first electrical switch diversion configured with a second electrical switch feed through configured; and a first electrical switch feed through configured with a second electrical switch feed through configured.

20. An electrically switched hydraulic control system as described in claim 18 wherein said combination of diverted and/or series paths for each electrical switch sequentially reconfigured by innervation and/or de-innervation of at least one position sensor connected with at least one switch comprises at least eight sequential switch configurations dynamically reconfigured through the innervation and/or de-innervation of said individual position sensors connected with at least one switch.

21. An electrically switched hydraulic control system as described in claim 20 wherein said at least eight sequential switch configurations dynamically reconfigured through the innervation and/or de-innervation of said individual position sensors connected with at least one switch comprises at least two separate transient dormant electrical switch configurations.

22. An intermediate flow hydraulic controller comprising:

a reservoir configured to contain a hydraulic fluid connected with a pump fluidically capable of displacing at least some of said hydraulic fluid through a transmission line fluidically responsive to said pump, coupled with at least one additional hydraulic transmission pathway configured to divert said hydraulic fluid preceding a hydraulic control valve at an intermediate pressure flow;

at least one actuator connected with said transmission line through said hydraulic control valve;

a hydraulic controller connected with said hydraulic control valve having:

a power source electrically connected with at least a first and a second switch in series connected with a hydraulic control valve through at least one electrical connection; and at least one position sensor connected with at least one switch such that innervation and/or de-innervation of said position sensor activates dynamic reconfiguration of said switch;

wherein said first and a second switches in series dynamically reconfigure to a transient dormant configuration such that said second switch is reconfigured from an open position (NO) to a closed position (NC) while said first switch maintains an open position interrupting the input to said second switch so as to prepare for a subsequent step of switching said first switch to an closed position thereby energizing said second switch and activating said hydraulic control valve toward a new position.

* * * * *